United States Patent [19]

Martin et al.

[11] Patent Number: 4,845,324

[45] Date of Patent: Jul. 4, 1989

[54] INTERRUPTER OPERATING MECHANISM

[75] Inventors: Donald R. Martin, Waukesha; Nils V. Holmgren, Greendale, both of Wis.

[73] Assignee: Cooper Power Systems, Inc., Houston, Tex.

[21] Appl. No.: 115,421

[22] Filed: Oct. 30, 1987

[51] Int. Cl.[4] ..... H01H 3/30

[52] U.S. Cl. ..... 200/400; 74/97

[58] Field of Search ..... 200/153 SC, 145, 144 B; 74/97

[56] References Cited

U.S. PATENT DOCUMENTS

| | | | |
|---|---|---|---|
| 2,862,075 | 11/1958 | Netzel | 200/70 |
| 3,670,123 | 6/1972 | Luehring | 200/145 |
| 3,845,263 | 10/1974 | Dickinson | 200/153 SC |
| 3,845,433 | 10/1974 | Kraulits | 335/254 |
| 3,911,240 | 10/1975 | Henderson | 200/153 SC |
| 4,095,676 | 6/1978 | Howe et al. | 185/40 |
| 4,124,790 | 11/1978 | Kumbera et al. | 200/144 B |
| 4,152,562 | 5/1979 | Kohler et al. | 200/153 SC |
| 4,159,404 | 6/1979 | Freeman | 200/145 |
| 4,162,385 | 7/1979 | Bould et al. | 200/153 SC |
| 4,168,414 | 9/1979 | Kumbera et al. | 200/153 G |
| 4,419,553 | 12/1983 | Ohshita et al. | 200/144 B |

*Primary Examiner*—Renee S. Luebke

*Attorney, Agent, or Firm*—Nelson A. Blish; Eddie E. Scott; Alan R. Thiele

[57] ABSTRACT

Apparatus for opening and closing a switch, which apparatus comprises a lever mounted on a frame for pivotal movement between a first position and a second position, a first spring biasing the lever from the second position to the first position, a cam and follower for effecting pivotal movement of the lever from the first position to the second position against the influence of the first spring, a step on the cam for permitting movement of the lever from the second position to the first position under the influence of the first spring after the lever has moved from the first position to the second position, a member adapted to be connected to the switch and movable between a switch opening position and a switch closing position, which member is movable to the switch closing position in response to movement of the lever from the second position to the first position, a second spring displaceable between extended and contracted conditions, which second spring is extended to the extended condition in response to movement of the member to the switch closing position, a latch for releasably retaining the second spring in the extended condition, and mechanism for releasing the latch and thereby also releasing the second spring from the extended condition for movement to the retracted condition so as thereby to displace the member to the switch opening position.

12 Claims, 5 Drawing Sheets

INTERRUPTER OPERATING MECHANISM

BACKGROUND OF THE INVENTION

The invention relates generally to current interrupters, i.e., to mechanisms for operating switches or interrupters by moving one contact relative to another contact.

It is known to provide such mechanisms with a first spring for providing the energy to close the switch and a second spring for providing the energy to open the switch, with the first spring also charging, or causing energy to be stored in, the second spring. For example, see U.S. Pat. No. 4,095,676, issued June 20, 1978.

SUMMARY OF THE INVENTION

The invention provides apparatus for opening and closing a switch, which apparatus comprises a lever mounted on a frame for pivotal movement between a first position and a second position, a spring biasing the lever from the second position to the first position, means for effecting pivotal movement of the lever from the first position to the second position against the influence of the spring, means for permitting movement of the lever from the second position to the first position under the influence of the spring after the lever has moved from the first position to the second position, a member adapted to be connected to the switch and movable between a switch opening position and a switch closing position, which member is movable to the switch closing position in response to movement of the lever from the second position to the first position, and means for selectively and rapidly moving the member to the switch opening position from the switch closing position.

In one embodiment of the invention, the means for moving the member to the switch opening position comprises a second spring displaceable between extended and contracted conditions, which second spring is extended to the extended condition in response to movement of the member to the switch closing position, together with means for releasably retaining the second spring in the extended condition, and means for releasing the retaining means and thereby also releasing said second spring from said extended condition for movement to said retracted condition so as thereby to displace the member to the switch opening position.

The invention also provides apparatus for opening and closing a switch, which apparatus comprises spring means operable between an extended condition in which energy is stored and a contracted condition, a member adapted to be connected to the switch, connected to the spring means, movable between switch open and switch closed positions, and movable to the switch open position in response to release of said spring means from the extended condition, means for extending the spring means from the contracted condition to the extended condition in response to movement of the member to the switch closed position, means for releasably retaining the spring means in the extended condition, means for releasing the retaining means and thereby releasing the spring means for movement from the extended condition to the contracted condition, which releasing means comprises solenoid means including a plunger movable between a retracted position and an extended position, which plunger releases said retaining means in response to plunger movement from the retracted position to the extended position, means for biasing the plunger to the extended position, and coil means for retaining the plunger in the retracted position, and means operable independently of the coil means for moving the plunger from the extended position to the retracted position and against the force of the biasing means in response to release of the spring means from the extended condition.

The invention also provides apparatus for opening and closing a switch, which apparatus comprises spring means operable between an extended condition in which energy is stored and a retracted condition, a member adapted to be connected to the switch, connected to the spring means, and movable to open the switch in response to release of the spring means from the extended condition to the contracted condition, operator actuatable means operable, when the spring means is in the contracted condition, to extend the spring means to the extended condition, and operable, when the spring means is in the extended condition, and in the absence of other means for releasing the spring means to the contracted condition, to displace the member to open the switch independently of the spring means, and means for releasing the spring means from the extended condition to the contracted condition in response to operation of the operator actuatable means when the spring means is in the extended condition.

The invention also provides a switchgear apparatus including three interrupters controlled by respective interrupter operating mechanisms as described above. Each of the interrupter operating mechanisms is controlled by a respective control circuit. Because the interrupters are separately controlled, any one or two of the interrupters can be opened without opening the other interrupter(s).

Other features and advantages of the invention will become known by reference to the following description, drawings and appended claims.

THE DRAWINGS

FIG. 1 is a side elevational view with parts omitted, of an interrupter operating mechanism incorporating various of the features of the invention.

FIGS. 2, 3, and 4 are views similar to FIG. 1 with various of the components of the switch operating mechanism shown in FIG. 1 shown in differing positions.

Figure 2:
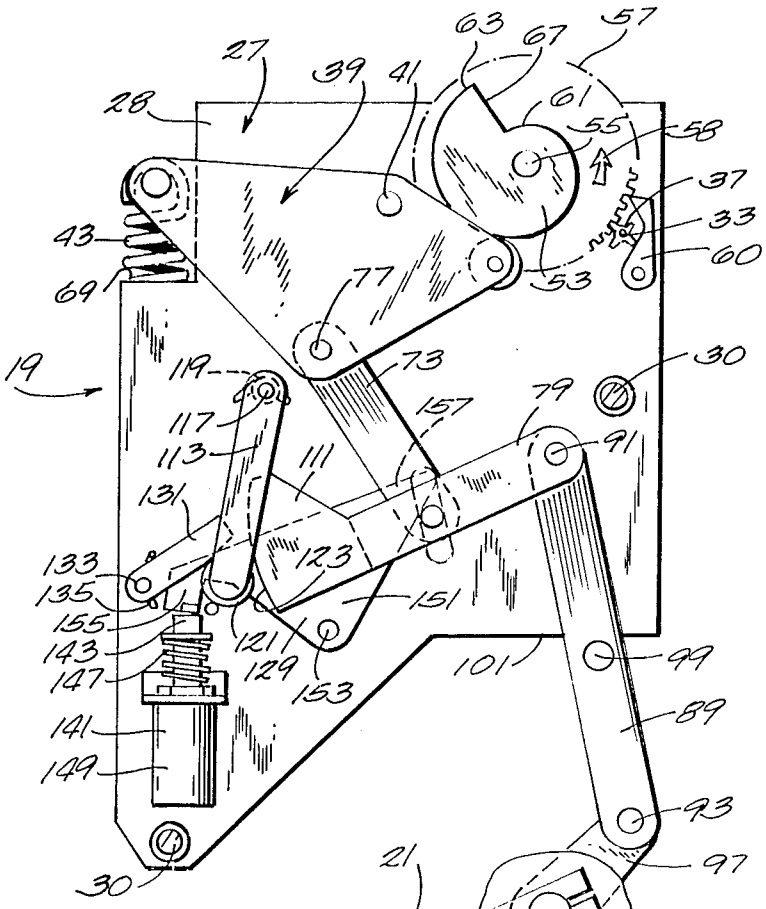

Before one embodiment of the invention is explained in detail, it is to be understood that the invention is not limited in its application to the details of construction and the arrangements of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

GENERAL DESCRIPTION

Shown in the drawings is a mechanism 19 for opening and closing a switch (not shown), i.e., for moving one contact (not shown) relative to another contact (not shown). The switch operating mechanism 19 is quick acting, and operates to rotate a switch actuating bell-crank 21 around a fixed pivot 23. Such rotation of the bell-crank 21 causes substantially up and down movement of a switch plunger or actuating rod 29 which is connected, at one end, to the free end of one arm 31 of the switch actuating bell-crank 21 and which, at the other end, is connected to the movable contact (not shown).

The switch operating mechanism 19 includes a frame 27. The frame 27 can take any suitable form and includes two generally identical plates 28 interconnected in spaced parallel relation by one or more transverse spacers 30. The switch operating mechanism 19 is actuated to cause closing of the contacts (not shown) by suitable rotation of an input member or shaft 33 which is suitably rotatably supported by the frame plates 28 and which has mounted thereon a pinion 37.

Figure 1:
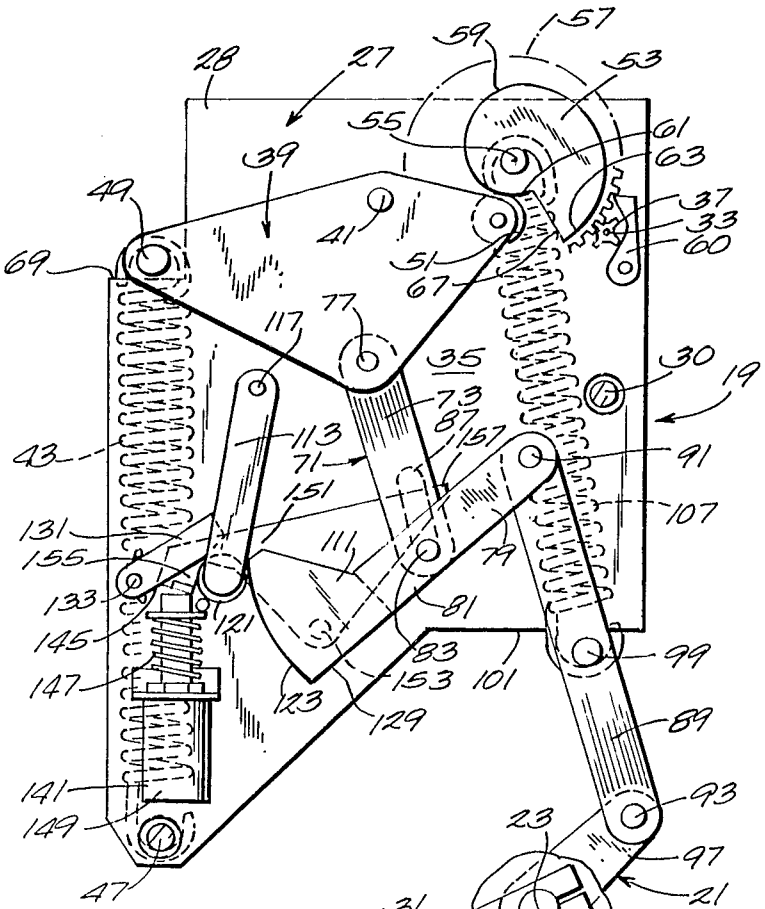
Figure 4:
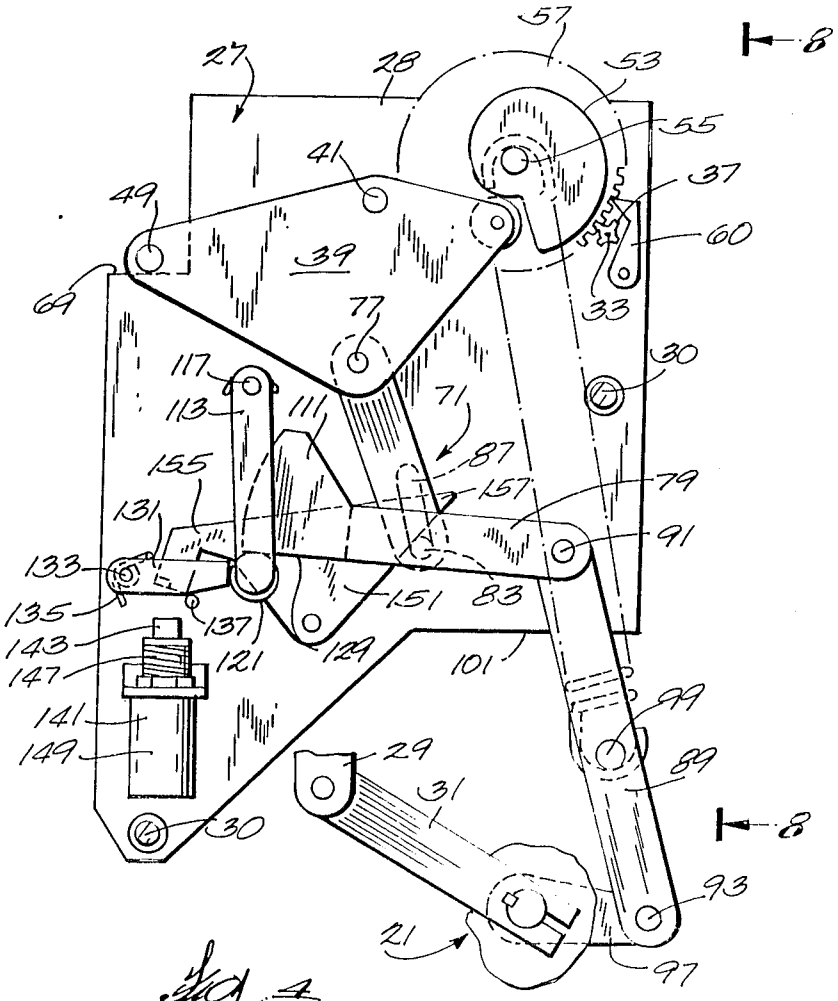
Figure 3:
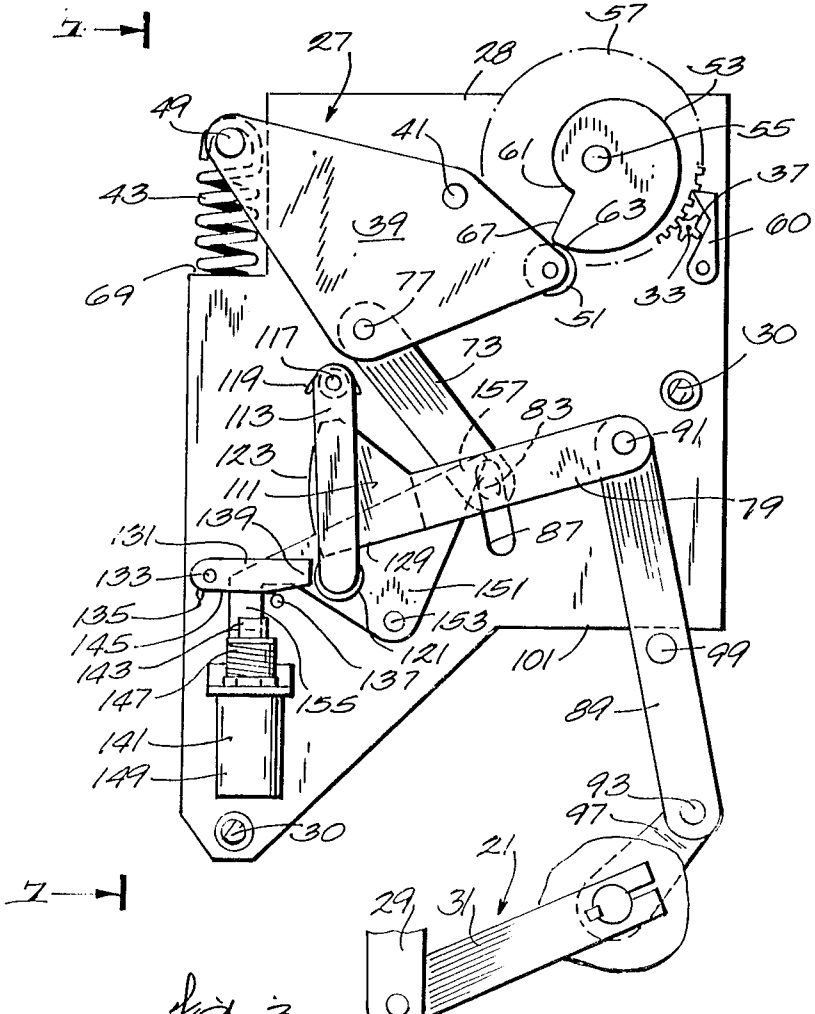

The switch operating mechanism 19 also includes, between the input shaft or member 33 and the switch actuating bell-crank 21, an operating linkage 35 including a main lever 39 which is mounted on a fixed pivot 41 on the frame plates 28 for oscillating movement between a first position which is shown in FIGS 1 and 4, and which is associated with a low point on a cam still to be described, and a second position which is shown generally in FIG. 3, and which is associated with a high point on the cam still to be described.

Figure 7:
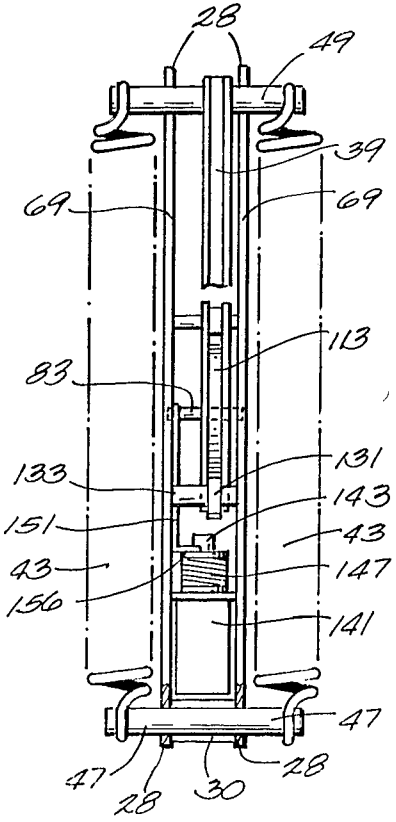
FIG. 7 is an end view taken along line 7—7 of FIG. 3.

Spring means is provided for biasing the main lever 39 in the counter-clockwise direction as shown in FIGS 1 through 4 from the second position shown in FIG. 3 to the first position shown generally in FIG. 1 and 4. While other constructions can be employed, in the illustrated construction, such biasing means comprises at least one helical main spring 43 which, at one end (the lower end), is connected to a projecting end 47 (FIG. 7) of one of the spacers 30 connecting the frame plates 28 and which, at the other end, is connected to a pin 49 extending from one end, i.e., the left end, of the main lever 39. In the disclosed construction two such springs 43 respectively engaged with the opposite ends of the pin 49 and with the opposite ends of the spacer 30 are employed.

Means is also provided for effecting pivotal movement of the main lever 39, against the action of the main spring 43, from the first position shown generally in FIGS 1 and 4, to the second position shown in FIGS. 3 in response to rotary movement of the input member or shaft 33. While various other constructions can be employed, in the illustrated construction, such means comprises cam and follower means for displacing the main lever 39 in the clockwise direction to the second position shown in FIG. 3 in response to cam rotation.

More specifically, the right end of the main lever 39 is provided with a roller 51 which is biased by the main springs 43 into engagement with a cam 53 having coaxial and common rotation (except as explained hereinafter) with a gear 57 in meshing engagement with the input shaft pinion 37. Both the cam 53 and the gear 57 are carried for rotation by a shaft 55 which is suitably supported on the frame plates 28. The cam 53 and gear 57 are driven in the counter-clockwise direction by the shaft 33 and pinion 37 as shown by the arrow 58 in FIG. 2. Also provided are suitable ratchet means 60 engaging the gear 57 to prevent reverse rotation of the gear 57 and the shaft 33.

The cam 53 has an outer periphery or profile 59 which provides for gradual movement of the main lever 39 from the first position to the second position and for affording or facilitating rapid movement of the main lever 39 from the second position to the first position in response to actuation by the main spring 43 and in response to cam movement in the counter-clockwise direction beyond a high point 63. Thus, in the disclosed construction, the radius to the periphery or profile 59 of the cam 53 gradually and constantly increases from a minimum radius at a low point 61 on the cam to a maximum radius at the high point 63 on the cam 59 to provide gradual movement of the main lever 39 from the first position (FIG. 1) to the second position (FIG. 3). The cam profile or periphery 59 also includes a step 67 which precipitously reduces the radius from maximum to minimum, and which provides for rapid movement of the main lever 49 from the second position to the first position under the influence of the main spring 43 and in response to cam movement in the counter-clockwise direction beyond the high point 63. Counter-clockwise movement of the main lever 39 is limited by engagement of the pin 49 with the upper edges 69 of portions of the frame plates 28.

The switch operating mechanism 19 also includes means for closing the switch (not shown) in response to movement of the main lever 39 from the second position shown in FIG. 3 to the first position shown in FIG. 4, i.e., for rotating the switch actuating bell-crank 21 from the position shown in FIGS. 1 through 3 to the position shown in FIG. 4. While other constructions can be employed, the disclosed construction, such means comprises a sub-linkage 71 including a series of three links comprising a first link 73 which, at one (upper) end, is pivotally connected at 77 to a main lever bottom part located in spaced relation to and generally below the pivot 41. The series of links also includes a second or middle link 79 which is pivotally connected at a mid portion 81 thereof to the other or lower end of the first link 73 by a pivot or center pin 83 which also extends into a generally vertically extending central slot 87 formed in the frame plates 28 and which thereby guides and limits travel of the mid portion 81 of the middle link 79.

The series of links also includes a third member or drive link 89 which, at its upper end, is pivotally connected at 91 to the right end of the second or middle link 79, which, at its lower or other end, is pivotally connected at 93 to the outer end of the other arm 97 of the switch actuating bell-crank lever 21, and which is movable between a switch closed position (FIG. 4) and a switch open position (FIGS. 1–3).

The third or drive link 89 has thereon a projection or stud 99 having opposite ends which are engageable with horizontal surfaces 101 on the frame plates 28 to limit upward movement of the drive link 89 and to provide a horizontally movable fulcrum affording limited movement of the drive link 89.

The switch operating mechanism also includes means for selectively moving the third link to the switch open position. While various other constructions can be employed, in the illustrated construction, such means comprises a second or switch opening spring or springs 107 displaceable between contracted and extended conditions, means for extending the springs 107 in response to movement of the drive link 89 to the switch closed position, mean for releasably retaining the drive link 89 in the switch closed position and the springs 107 in the extended condition, and means for releasing the retaining means to release the second springs 107 from the extended condition and to cause displacement of the drive link 89 to the switch open position.

The second or switch opening springs 107 bias the drive link 89 upwardly and are cocked or charged, i.e., are extended to store energy therein, in response to movement of the sub-linkage 71 to downwardly displace the drive link 89 and thereby to close the switch contacts (not shown) when the main lever roller 51 drops from the high point 63 on the cam 53 to the low point 61.

More specifically, while other constructions can be employed, in the illustrated construction, the second or switch opening springs 107 are helical springs which extend on opposite sides of the plates 28, which, at their lower ends, are connected to the third or drive link 89 and which, at their upper ends, are connected to the frame plates 28. Still more specifically, the upper ends of the springs 107 are hooked or anchored to the shaft 55 supporting the gear 57, and the lower ends of the springs 107 are anchored or hooked to the stud 99 on the third or drive link 89. Other arrangements could obviously be employed. As a consequence, the springs 107 urge upwardly the third or drive link 89 and urge the pin or stud 99 into engagement with the horizontal surface 101.

When the main lever 49 is in the first position (FIG. 1) and when the stud 99 engages the frame plates 28, the center pin 83 is located at or near the bottom of the slot 87 and the second or middle link 79 is inclined upwardly and to the right at shown in FIG. 1.

As the main lever 39 rotates in the counter-clockwise direction away from the first position (FIG. 1) and in response to cam rotation, the upper end of the first link 73 is raised and moved somewhat to the left as shown in FIG. 2, with consequent raising of the center pin 83 and clockwise movement of the second or middle link 79 about its pivotal connection 91 with the third or drive link 89.

Continued counter-clockwise movement of the main lever 39 in response to continued rotation of the cam 53 causes the center pin 83 to move to adjacent the upper end of the central slot 87 in the frame plates 28 at about the same time as when the roller 51 comes into engagement with the high point 63 on the cam 53.

Such counter-clockwise movement of the second or middle link 79 about the pivotal connection 91 with the third or drive link 89 (which is held against upward movement by engagement of the stud 99 with the frame surface 101) serves to pivot the second or middle link 79 to a latch position (shown in FIG. 3) with the center pin 83 in the upper portion of the central slot 87 in the frame plates 28 and with an enlarged left end portion 111 of the second or middle link 79 in a raised condition.

While other constructions could be employed, the means for releasably retaining or latching the springs 107 in the extended condition comprises means for releasably retaining or latching the second or middle link 79 in the latch position. While other constructions can be employed, in the illustrated construction, such means comprises a latching lever 113 which, at its upper end, is pivotally mounted on the frame plates 28 about a pivot 117 and which is biased in the counter-clockwise direction by means in the form of a suitable spring 119. At its lower end, the latching lever 113 supports a latching roller 121 which, during movement of the main lever 39 from the first position, is held in engagement by the spring 119 with the arcuate end surface 123 of the enlarged left end portion 111 of the second or middle link 79. However, when the middle link 79 moves to the latch position, the latching roller 121 rides, under the influence of the spring 119, under the bottom left edge 129 of the middle link 79, thereby releasably restraining the middle link 79 in the latch position, i.e., preventing downward movement of the left end of the middle link 79.

Upon further rotation of the cam 53, the roller or follower 51 rides off the high point 63 with the result that the main lever 39 moves rapidly in the clockwise direction under the influence of the main springs 43. Such movement, with the left end of the middle lever 79 held in elevated position by the latching lever 113 and roller 121, serves to rapidly displace the middle lever 79 in the counter-clockwise direction about the point of engagement of the middle lever 79 with the latching roller 121 (which engagement serves as a fulcrum). Such rapid counter-clockwise movement of the middle lever 79 rapidly drives downwardly the third or drive link 89, thereby displacing the stud 99 from the surface 101, thereby expanding, and storing energy in, the switch opening springs 107, and thereby also rotating the switch actuating bell-crank 21 to rapidly move the moveable switch contact (not shown) into closed position with the other switch contact (not shown).

The switch operating mechanism 19 also includes a blocking lever 131 which is pivotally mounted, at its left end, on a fixed pivot 133 on the frame plates 28, which is biased by means in the form of a suitable spring 135 in the clockwise direction to a retaining or blocking position in engagement with a stop 137 fixed on the frame plates 28. In the blocking or retaining position, the outer or right end 139 of the blocking lever 131 engages the latching roller 121 to prevent movement thereof to the left and out of latching engagement with the lower edge 129 of the enlarged left end portion 111 of the middle link 79. Thus, when the blocking lever 131 is in the blocking position, release of the middle lever 79 from the position shown in FIG. 4 is prevented and the third or drive link 89 remains in the cocked lower position and the switch opening springs 107 remain cocked.

The blocking lever 131 can be considered a part of the means for retaining the springs 107 in the extended condition, or can be considered part of the below-described means for releasing the retention of the sub-linkage 71. The switch operating mechanism 19 also includes means for releasing the retention of the sub-linkage 71 in the position shown in FIG. 4, i.e., for releasing the retention of the switch opening springs 107 in extended or cocked condition. While other constructions can be employed, in the illustrated construction, such means comprises means for displacing the blocking means from the blocking position. While other constructions can be employed, in the illustrated construction, such displacing means comprises a magnetic latch 141 mounted on the frame plates 28 and including a plunger 143 which is movable between an extended position and a retracted position, which is engageable with the lower edge 145 of the blocking lever 131, and which, when in the extended position, displaces upwardly the blocking lever 131 from its blocking position. The plunger 143 is biased outwardly by a spring 147 toward the extended position. In addition the latch 141 includes a permanent magnet 149 which develops sufficient pull or force to retain the plunger 143 in the retracted position, which force is, however, insufficient to pull the plunger 143 from the extended position to the retracted position. The magnetic latch 141 can be controlled by a relatively small electrical signal to a coil that cancels out the permanent magnet to release the plunger 143.

Such means for releasing the retention of the sub-linkage 71 in cocked position (as shown in Fig. 4) also includes a reset lever 151 (FIG. 3) which is pivotally mounted on a pivot 153 fixed on the frame plates 28 and which includes a left end portion 155 having a foot 156 (See FIG. 7) positioned to engage the solenoid plunger 143 and, in response to counter-clockwise movement of the reset lever 151, to displace the solenoid plunger 143 from the extended position (against the action of the solenoid spring 147) to the retracted position. As already noted, the coil 149 is capable of developing sufficient force to retain the solenoid plunger 143 in the retracted position.

The reset lever 151 also includes a right end portion 157 which engages the center pin 83 which is movable in the central slot 87 in the frame plates 28 during linkage movement as already mentioned. More specifically, the reset lever 151 is proportioned such that when the main lever 39 is in the first position and the center pin 83 is adjacent the bottom of the slot 87, as shown in FIG. 1, the left end portion 155 of the reset lever 151 is elevated so as to permit extension of the solenoid plunger 143 to its extended position under the influence of the spring 147 (which also serves to bias the reset lever 151 in the clockwise direction so as to engage the right end portion 157 with the center pin 83).

When the center pin 83 moves upwardly in the slot 87 during movement of the main lever 39 from the first position (FIG. 1) to the second position (FIG. 3), the reset lever 151 is displaced in the counter-clockwise direction against the action of the solenoid spring 147 to locate the solenoid plunger 143 in the retracted position. Thus, the sub-linkage 71 will be retained in the condition shown in FIG. 4 (with the switch opening springs 107 extended) and with the switch (not shown) in closed condition during continued energization of the solenoid coil 149.

However, when the solenoid coil 149 is de-energized by an operator or by a control circuit, the spring 147 will upwardly displace the solenoid plunger 143 to the extended position, thereby displacing the blocking lever 131 against the action of its biasing spring 135 out of its blocking position with respect to the latching roller 121 on the retaining or latching lever 113. When the blocking lever 131 is displaced from its blocking position, the force acting between the middle link 79 and the latching roller 121 on the retaining or latching lever 113 (which force is applied by the switch opening springs 107) overcomes the bias of the retaining or latching lever spring 119 and displaces the retaining or latching lever 113 in the clockwise direction to displace the roller 121 from engagement with the left bottom edge 129 of the middle lever 79.

When the roller 121 disengages from the left bottom edge 129 of the middle lever 79, the switch opening springs 107 are free to cause rapid upward travel of the third or drive link 89, thereby rapidly opening the switch contacts (not shown). Such rapid upward movement of the third or drive link 89 relocates the stud 99 against the horizontal surface 101 on the frame plates 28 and also relocates the sub-linkage 71 in the condition shown in FIG. 1. In particular, such upward movement of the third or drive link 89 when the main lever 39 is in the first position (shown in FIGS. 1 and 4) causes the right end of the middle link 79 to move upwardly and causes the middle link 79 to pivot in the counter-clockwise direction about the pivotal connection 91 with the third or drive link 89, i.e., causes the left end portion 111 of the middle link 79 to move downwardly. During such downward movement of the left end portion 111 of the middle link 79, the retaining or latching roller 121 travels along the outer edge 123 of the left end portion 111 of the middle link 79 to the upper end thereof. At the same time, the retaining or latching roller 121 engages (see FIG. 1) the lower edge 145 of the blocking lever 131 to retain the blocking lever 131 away from the blocking position in engagement with the stop 137.

In order to prevent improper operation of the switch (not shown), i.e., opening of the switch before it is fully closed, it is important that the drive link 89 move completely to its lower or switch closed position before the blocking lever 131 is displaced from its blocking position. Therefore, the switch operating mechanism 19 is constructed so that the angle at which the bottom edge of the middle lever 79 engages the roller 121 is such that the latching lever 113 is not biased in the clockwise direction by the force acting between the middle link 79 and the roller 121 until the drive link 89 is in its lower position. Accordingly, regardless of the position of the blocking lever 131, the roller 121 will not move out of engagement with the left bottom edge 129 of the middle lever 79 (and thereby permit upward movement of the drive link 89) unless the drive link 89 is in its lower position.

In order to prevent gradual opening of the switch contacts (not shown), which gradual opening might otherwise disadvantageously occur if the switch operating mechanism 19 is in the condition shown in FIG. 4 and the cam 53 is inadvertently rotated beyond one revolution so as to thereby otherwise cause elevation or raising of the downwardly extending drive link 89 from the cocked position shown in FIG. 4, the switch operating mechanism 19 also includes means operative to rapidly open the switch contacts upon excessive rotation of the input shaft beyond one rotation and after downward projection of the drive link 89 and consequent closing of the switch contacts (not shown).

Figure 5:
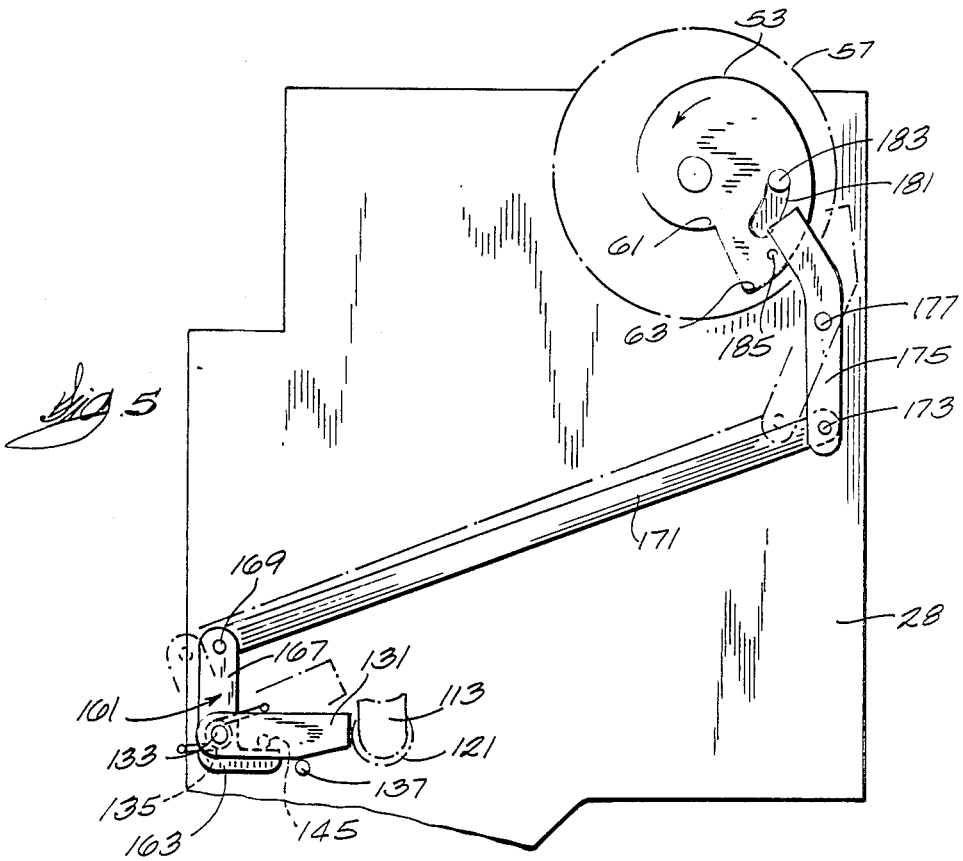
FIGS. 5 and 6 are views similar to FIG. 1 with various of the components of the switch operating mechanism shown in FIG. 1 omitted, and with various of the components shown in different positions.
Figure 6:
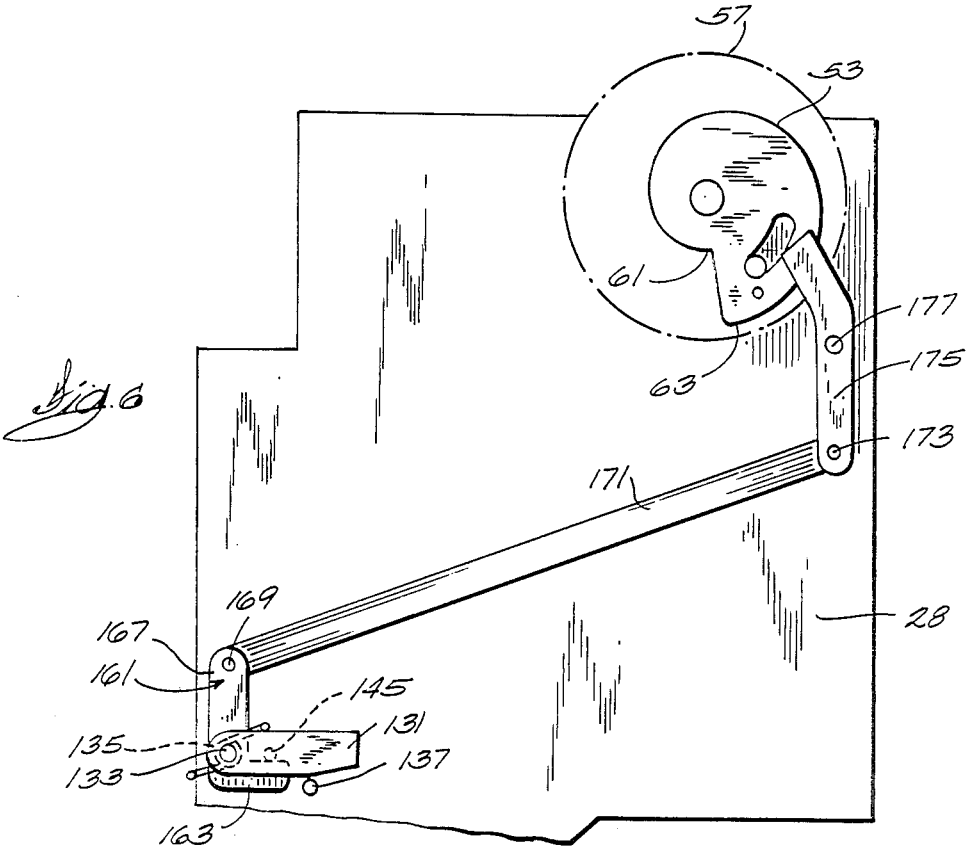
Figure 8:
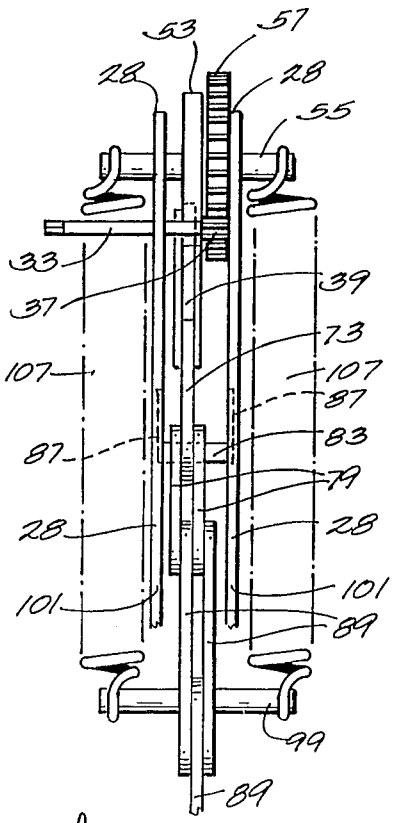
FIG. 8 is an end view taken along line 8—8 of FIG. 4.

While other constructions can be employed, in the illustrated construction such means comprises a bell-crank 161 (see FIGS. 5 and 6) which is co-axially mounted with the blocking lever 131 on the pivot 133 and which includes a lower or horizontal arm 163 which engages a pin 145 on the blocking lever 131. The other or upright arm 167 of the bell-crank 161 is, at its outer end, pivotally connected at 169 to one (the lower) end of an actuating link 171 which, at its other or upper end, is pivotally connected at 173 to the bottom end of a lever 175 which is pivotally mounted intermediate its ends about a pivot 177 fixed on the frame plates 28. Because of the engagement between the blocking lever 131 and the lower arm 163 of the bell-crank 161, and because the blocking lever spring 135 biases the blocking lever 131 in the clockwise direction, the spring 135 also biases the bell-crank 161 in the same clockwise direction and, through the link 171, biases the lever 175 in the counter-clockwise direction.

When the lever 175 is pivoted against the action of the spring 135, i.e., in the clockwise direction, the link 171 is activated to rotate the bell-crank 161 in the counter-clockwise direction, thereby elevating the lower arm 163 and correspondingly pivoting the blocking lever 131 from its blocking position. As a consequence, the force applied by the switch opening springs 107 between the middle link 79 and the latching roller 121 will cause the latching roller 121 to be displaced to the left and off the left bottom edge 129 of the middle link 79, thereby releasing the left end of the middle link 79 for downward movement and causing rapid upward movement of the drive link 89 under the influence of the switch opening springs 107 to open the switch contacts (not shown).

This means for opening the switch contacts (not shown) also includes means for displacing the lever 175 in the clockwise direction in response to excessive rotation of the input shaft 33. While other constructions can be employed, in the illustrated construction, such means comprises a pin or boss 185 (FIG. 5) which extends from the cam 53, and which, in response to cam rotation, engages the upper end of the lever 175 to displace the lever 175 in the clockwise direction.

When the pin or boss 185 rides past the upper end of the lever 175, the blocking lever biasing spring 135 serves to again bias the blocking lever 131 in the direction toward the blocking position and will, when the roller 121 is again beneath the middle link 79, relocate the blocking lever 131 in the blocking position, and will also relocate the lever 175 in the position for subsequent engagement by the pin or boss 185.

Also, in order to prevent gradual closing of the switch contacts (not shown) which might otherwise disadvantageously occur if movement of the cam 53 from the high point to the low point is hindered, means is provided for permitting limited free forward rotational displacement of the cam 53, i.e., movement in the counter-clockwise direction relative to the gear 57.

More particularly, the means for providing limited free forward relative rotation between the cam 53 and the gear 57 comprises pin and slot means. While other constructions could be employed, in the illustrated construction, such pin and slot means comprises an arcuate slot 181 in the cam 53 and a pin 183 fixedly extending from the gear 57 and into the slot 181. Accordingly, the pin 183 normally engages the leading end of the slot 181 and rotatably drives the cam 53 with the gear 57. However, the cam 53 is free to move relative to the gear in the counter-clockwise direction and away from the pin 183 to assure the absence of interference by the cam 53 with movement of the main lever roller 51 from the high point 63 to the low point 61 of the cam.

Figure 9:
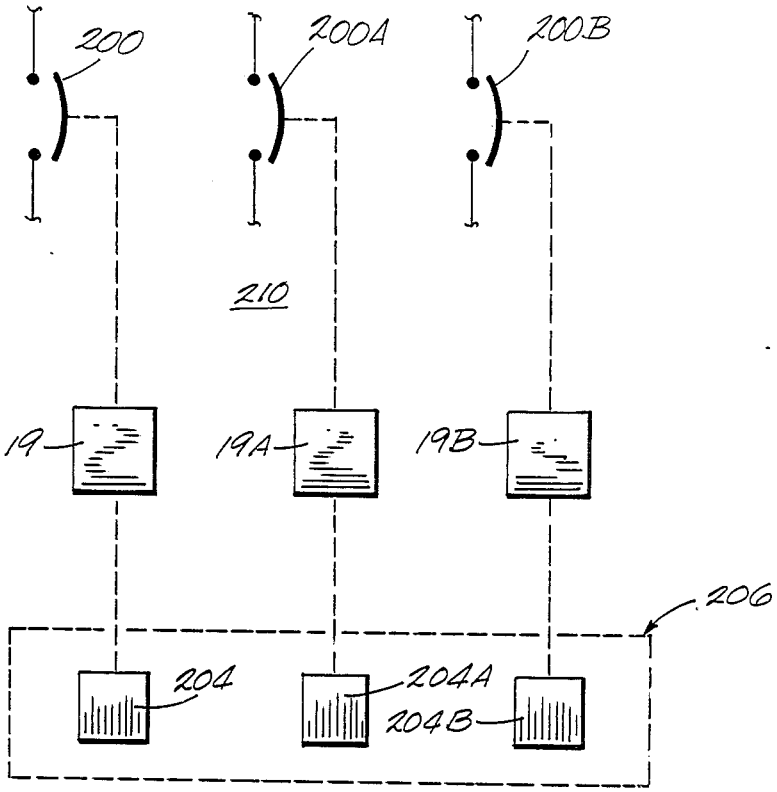
FIG. 9 is a schematic view of switchgear apparatus including three interrupter operating mechanisms as shown in FIGS. 1–8.

Illustrated schematically in FIG. 9 is a switchgear apparatus 210 including three interrupters 200, 200A and 200B (shown schematically) controlled by respective interrupter operating mechanisms 19, 19A and 19B (shown schematically). While the interrupters 200, 200A and 200B can have any suitable construction, an example of a suitable interrupter is disclosed in Holmgren U.S. Pat. No. 4,489,226, which issued Dec. 18, 1984, and which is incorporated herein by reference. The preferred construction of the interrupters is disclosed in copending U.S. Pat. Application Ser. No. 115,529, titled "SUIDICE SWITCH/INTERRUPTER WITH VARIABLE VOLUME CHAMBER AND PUFFER ACTION", which is incorporated herein by reference, which is assigned to the assignee of the present application and which was filed concurrently herewith.

The operating mechanisms 19, 19A and 19B are controlled by control circuit means 206 (shown schematically) for monitoring current through the lines and for actuating the mechanisms 19, 19A and 19B when the current exceeds a predetermined limit. Preferably, the interrupter operating mechanisms 19, 19A and 19B are controlled by respective control circuits 204, 204A and 204B which operate independently. While various suitable control circuits can be employed, an example of a suitable control circuit is disclosed in Dewey U.S. Pat. No. 3,105,920, which issued Oct. 1, 1963, and which is incorporated herein by reference. The preferred construction of the control circuits 204, 204A and 204B is disclosed in copending U.S. Pat. Application Ser. No. 115,530, titled "LINE CURRENT TO TIME INTERPOLATER CIRCUIT", which is assigned to the assignee of the present application, which was filed concurrently herewith, and which is incorporated herein by reference.

Each of the interrupters 200, 200A and 200B is associated with a single phase of a three-phase power supply. Because a separate control arrangement (interrupter operating mechanism 19, 19A or 19B and control circuit 204, 204A or 204B) is used for each phase, any one or two of the phases can be interrupted without interruption of the other phase(s).

Various of the features of the invention are set forth in the following claims.

We claim:

1. Apparatus for opening and closing a switch, said apparatus comprising a frame, a lever mounted on said frame for pivotal movement between a first position and a second position, a spring biasing said lever from said second position to said first position, means for effecting pivotal movement of said lever from said first position to said second position against the influence of said spring, means for permitting movement of said lever from said second position to said first position under the influence of said spring after said lever has moved from said first position to said second position, a member adapted to be connected to the switch and movable between a switch open position and a switch closed position, said member being movable to said switch closed position in response to movement of said lever from said second position to said first position, and means independent of said spring for selectively and rapidly moving said member to said switch open position from said switch closed position.

2. Apparatus as set forth in claim 1 wherein said means for effecting pivotal movement of said lever from said first position to said second position includes cam means.

3. Apparatus in accordance with claim 1 wherein said means for moving said member to said switch open position comprises a second spring displaceable between extended and contracted conditions, said second spring being extended to said extended condition in response to movement of said member to said switch closed position, means for releasably retaining said second spring in said extended condition, and means for releasing said retaining means and thereby also releasing said second spring from said extended condition for movement to said retracted condition so as thereby to displace said member to said switch open position.

4. Apparatus as set forth in claim 3 and further comprising means for preventing operation of said means for releasing said retaining means unless said member is in said switch closed position.

5. Apparatus as set forth in claim 3 wherein said releasing means includes a plunger movable between a retracted position and an extended position, and means for retaining said plunger in said retracted position, and wherein said apparatus further comprises means for moving said plunger from said extended position to said retracted position in response to movement of said lever from said first position to said second position.

6. Apparatus for opening and closing a switch, said apparatus comprising a frame, a lever mounted on said frame for pivotal movement between a first position and a second position, a spring biasing said lever from said second position to said first position, means for effecting pivotal movement of said lever from said first position to said second position against the influence of said spring, means for permitting movement of said lever from said second position to said first position under the influence of said spring after said lever has moved from said first position to said second position, a member adapted to be connected to the switch and movable between a switch open position and a switch closed position, said member being movable to said switch closed position in response to movement of said lever from said second position to said first position, and means for selectively and rapidly moving said member to said switch open position from said switch closed position, said means for moving said member to said switch open position comprising a second spring displaceable between extended and contracted conditions, said second spring being extended to said extended condition in response to movement of said member to said switch closed position, means for releasably retaining said second spring in said extended condition, and means for releasing said retaining means and thereby also releasing said second spring from said extended condition for movement to said retracted condition so as thereby to displace said member to said switch open position.

7. Apparatus as set forth in claim 6 wherein said means for effecting pivotal movement of said lever from said first position to said second position includes cam means.

8. Apparatus as set forth in claim 6 and further comprising means for preventing operation of said means for releasing said retaining means unless said member is in said switch closed position.

9. Apparatus as set forth in claim 6 wherein said releasing means includes a plunger movable between a retracted position and an extended position, and means for retaining said plunger in said retracted position, and wherein said apparatus further comprises means for moving said plunger from said extended position to said retracted position in response to movement of said lever from said first position to said second position.

10. Apparatus for opening and closing a switch, said apparatus comprising spring means operable between an extended condition in which energy is stored and a contracted condition, a member adapted to be connected to the switch, connected to said spring means, movable between switch open and switch closed positions, and movable to the switch open position in response to release of said spring means from said extended condition, means for extending said spring means from said contracted condition to said extended condition in response to movement of said member to said switch closed position, means for releasably retaining said spring means in said extended condition, means for releasing said retaining means and thereby releasing said spring means for movement from said extended condition to said contracted condition, said releasing means comprising solenoid means including a plunger movable between a retracted position and an extended position, said plunger releasing said retaining means in response to plunger movement from said retracted position to said extended position, means for biasing said plunger to said extended position, and coil means for retaining said plunger in said retracted position, and means operable independently of said coil means for moving said plunger from said extended position to said retracted position and against the force of said biasing means in response to release of said spring means from said extended condition.

11. An apparatus for opening and closing a switch, said apparatus comprising spring means operable between an extended condition in which energy is stored and a retracted condition, a member adapted to be connected to the switch, connected to said spring means, and movable to open the switch in response to release of said spring means from said extended condition to said contracted condition, operator actuatable means operable, when said spring means is in said contracted condition, to extend said spring means to said extended condition, and operable, when said spring means is in said extended condition, and in the absence of other means for releasing said spring means to said contracted condition, to displace said member to open the switch independently of said spring means, and means for releasing said spring means from said extended condition to said contracted condition in response to operation of said operator actuatable means when said spring means is in said extended condition.

12. An apparatus for opening and closing a switch, said apparatus comprising a link having opposite first and second ends and a middle portion, said first end being adapted to be connected to the witch for opening and closing the switch and being movable relative to a normal position, said middle portion being movable relative to a normal position, and said second end being movable between a normal position and a second position, first spring means for biasing said first end in one direction and to said normal position, second spring means for biasing said middle portion in the opposite direction and to said normal position, means for moving said middle portion in said one direction and against said second spring means so that said second end moves in said one direction from said normal position to said second position, means for releaseably retaining said second end in said second position, means operable when said second end is in said second position for permitting said middle portion to move in said opposite direction and under the influence of said second spring means so that said first end moves, against the force of said first spring means, in said opposite direction and away from said normal position, and means for releasing said retaining means so that said first end moves, under the influence of said first spring means, in said one direction and to said normal position.

* * * * *